US005222610A

United States Patent [19]

Johansen et al.

[11] Patent Number: 5,222,610

[45] Date of Patent: Jun. 29, 1993

[54] MODULAR MARKER DISPLAY STAND

[76] Inventors: Erling W. Johansen, 41 Belcher Rd.; Peter J. Grabowsky, 35 Stillwater Rd., both of Blairstown, N.J. 07825

[21] Appl. No.: 728,300

[22] Filed: Jul. 11, 1991

[51] Int. Cl.[5] ..... A47F 5/00

[52] U.S. Cl. ..... 211/69.5; 211/170; 211/194

[58] Field of Search ..... 211/69.5, 69.1, 70, 211/170, 171, 194, 164

[56] References Cited

U.S. PATENT DOCUMENTS

| | | | |
|---|---|---|---|
| 253,290 | 2/1882 | Hunter | 211/164 X |
| 499,881 | 6/1893 | Goldstein | 211/170 X |
| 846,133 | 3/1907 | McIntyre | 211/164 X |
| 2,592,189 | 4/1952 | Rothrock | 211/74 X |
| 2,962,156 | 11/1960 | Adams | 211/164 X |
| 3,273,846 | 9/1966 | De Mare | 211/69.5 X |
| 4,175,807 | 11/1979 | Kranich et al. | 211/194 |
| 4,374,565 | 2/1983 | Neumann | 211/69.5 |
| 4,537,315 | 8/1985 | Griffin | 211/170 X |

*Primary Examiner*—Robert W. Gibson, Jr.
*Attorney, Agent, or Firm*—Aquilino & Welsh

[57] ABSTRACT

A modular stand which includes a pair of geometrically shaped end wall members and an article supporting member positioned therebetween. The end wall members include dovetail tongue and grooves which allow them to be connected to one another. A cylindrical holder is positioned on both sides of each end wall member for engaging the ends of the article supporting member. The ends of the article supporting member are configured to matingly engage and connect with a corresponding cylindrical holder formed in the side of the end wall members. The article supporting member can engage the end wall members so as to be selectively positionable at a plurality of angles, thereby allowing the articles supported therein to be displayed at a selected angle.

19 Claims, 4 Drawing Sheets

MODULAR MARKER DISPLAY STAND

BACKGROUND OF THE INVENTION

1. Field of the Invention

The present invention relates to a modular stand or rack system for displaying a plurality of articles, such as markers, pens, and pencils.

More particularly, the invention is directed to new and useful improvements in display stands used by businesses to display articles for sale and used by artists and draftsmen for storing and conveniently displaying during use any number of markers in their work area.

2. Description of the Prior Art

Prior Art devices used for displaying markers at the retail point of purchase are usually large, thereby requiring a large portion of retail space. These systems usually have poor visual as well as physical access to the complete marker or article as they usually consist of a plurality of compartments, thereby making it difficult for a purchaser to make a selection.

Consequently, the need occurred for a modular display system which allows for easy visual and physical access for articles and can be configured to fit into just about any allotted amount of retail space.

A modular display system will also allow artists to work more efficiently. Artists purchase markers either singly or in sets which have multiple shades of a single color. As the number of their markers and marker sets grows, so must their display stands. In order to ensure maximum visibility and use of all markers, artists need adequate and expandable marker display stands. The modular display system of this invention was developed to meet this need.

SUMMARY OF THE INVENTION

The preferred embodiment of the invention relates to a modular stand for displaying a plurality of marking pens comprising a plurality of modular units. Each modular unit includes a pair of end wall members with an article supporting member connected therebetween. The article supporting member may have a plurality of recesses for holding the ends of the markers to be displayed or may have recesses such as a tray well for holding numerous objects in one well.

It is an object of this invention to provide a display stand which can conveniently and attractively display a large number of articles in a limited amount of space.

It is another object of the present invention to provide a display stand which can be assembled to vertically display a plurality of markers and can grow in both horizontal and vertical planes. That is, the modular stand shall have end wall members that allow assembly in a side-to-side relationship, a front-to-back relationship, and an up-and-down relationship.

A further object is to provide a novel connection means which allows the upper surface of the article supporting member to be selectively locked and positioned at a plurality of angles, thus permitting rows of objects to be displayed, while allowing each row to be displayed without physical or visual obstruction.

Still a further object of the invention is to provide a modular stand which is sturdy and can be assembled easily and quickly for supporting an indefinite amount of markers in an organized fashion.

Other objects and advantages of the present invention will become more apparent upon reference to the following specification and drawings.

DESCRIPTION OF THE PREFERRED EMBODIMENTS

The modular display stand of the present invention is shown assembled in a variety of configurations in FIGS. 1 through 4. Each modular unit 10 comprises a pair of end wall members 20 and an article supporting member 40.

Figure 10:
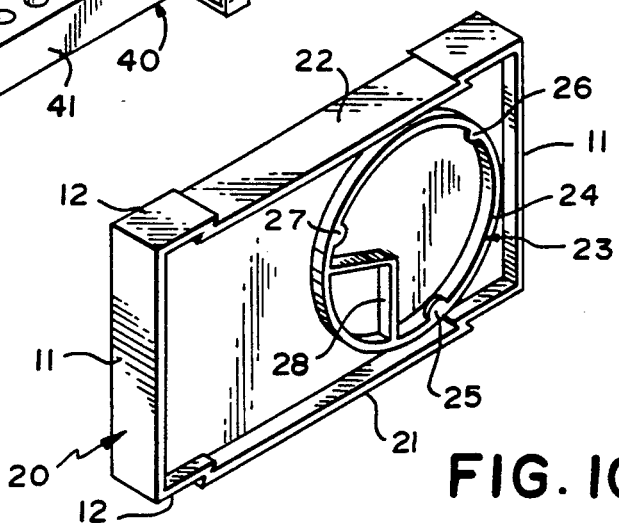
FIG. 10 is an enlarged perspective view of an end wall member.

The end wall members 20 are identical and an enlarged view is shown in FIG. 10. The end wall members are generally rectangular and include short edges 11 and long edges 12. Each end wall member 20 includes at least one tongue 21 and at least one groove 22 on opposing edges to allow the end wall members 20 to be connected together in a dovetail fashion, as seen in FIGS. 1–4. The tongue and groove could be located on any opposing edges of an end wall member 20 to allow for interconnecting in a plurality of directions (i.e., up and down, front to back).

Female connection means 23, located on both sides of the end wall member 20, include an outer cylindrical wall 24 having a plurality of retaining tabs 25, 26, and 27. Retaining tab 26 also functions as an aligning means for aiding in the attachment of the article supporting member 40 to the end wall member 20.

Enclosed within the outer cylindrical wall 24 is a stop 28 having angles walls for limiting the range of travel of the article supporting member 40 in both clockwise and counterclockwise directions.

Figure 5:
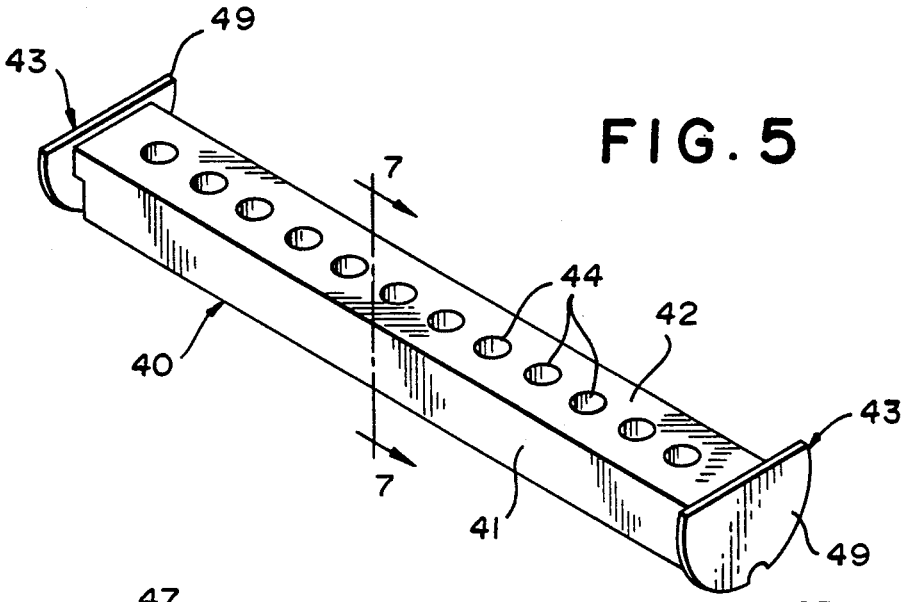
FIG. 5 is an enlarged perspective view of an article supporting member.
Figure 6:
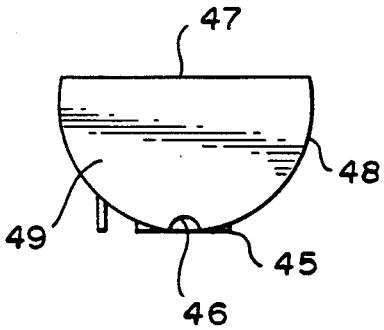
FIG. 6 is an end view of the article retaining member.
Figure 7:
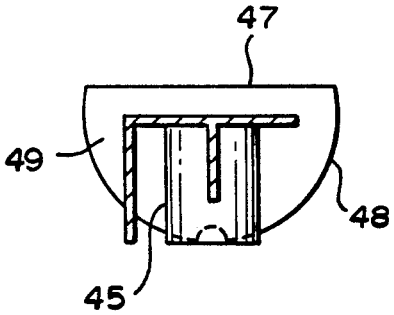
FIG. 7 is a cross-section shown at line 7—7 in FIG. 5.

The article supporting member 40 will be described with reference to FIGS. 5 through 7. The upper surface 42 includes a plurality of article retaining recesses 44 which are in the form of cup-shaped holders 45 as shown in FIG. 7. These holders 45 function to retain the cap of individual markers 60, while preventing the markers 60 from jamming and providing easy removal of the markers. The article supporting member 40 also includes a front face 41.

Figure 11:
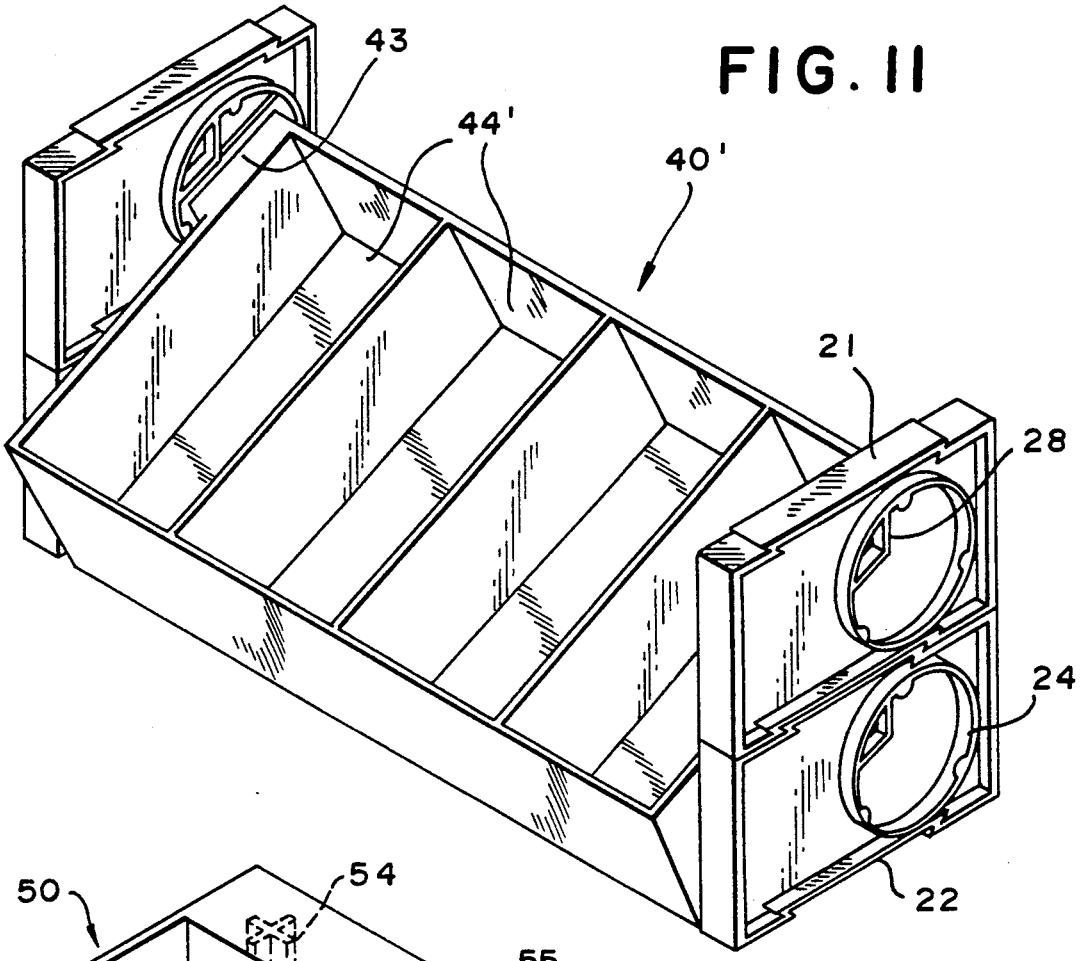
FIG. 11 is an embodiment in which the article supporting member is in the form of a tray.

The article supporting member may come in numerous different shapes and sizes depending upon the articles which are going to be displayed. FIG. 11 shows an article supporting member 40' which is in the form of a sectioned tray. The article supporting member 40' includes recesses 44' and can hold objects as well as a variety of different objects.

At the ends of the article supporting member 40 or 40' are male connection means 43. The male connection means 43 are in the form of semicircular discs 49, which have an aligning cutout 46 at approximately the midpoint of its circular circumference 48.

Figure 8:
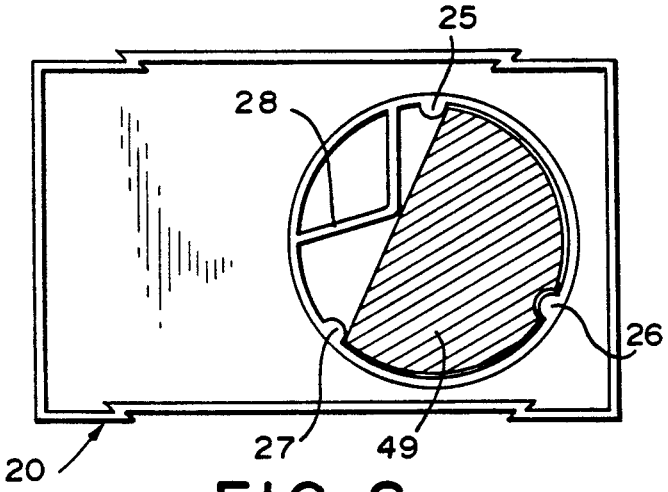
FIG. 8 is a side view showing the semi-circular disc of the article supporting member aligned with the cylindrical outer wall of the female connection means.
Figure 9:
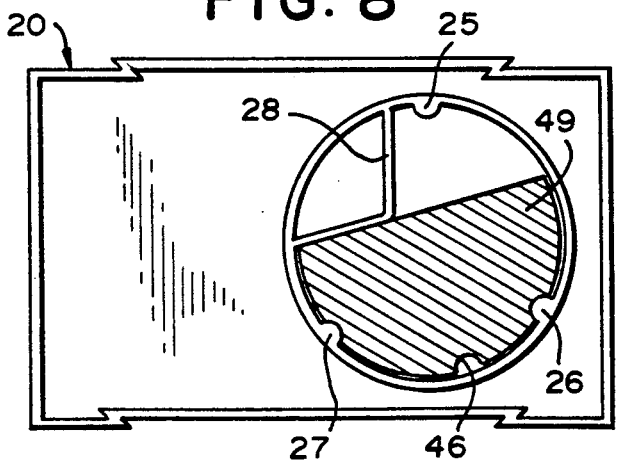
FIG. 9 is a side view of the semi-circular disc of the article supporting member shown in a rotated position.

The end wall members 20 and the article supporting member 40 are attached together by female connection means 23 and male connection means 43. Aligning cutout 46 and aligning tab 26 cooperate to properly position member 20 relative to member 40, as shown in FIG. 8. Once in proper position, the semi-circular disc 49 of the male connection means 43 can enter the outer cylindrical wall 24 of the female connection means 23. The semi-circular disc 49 may then be turned clockwise or counterclockwise until its straight edge 47 abuts against stop 28 as shown in FIG. 9. The male connection means 43 is retained within the female connection means 23 by either tabs 26 and 27 or tabs 25 and 26 depending on the direction turned.

Figure 12:
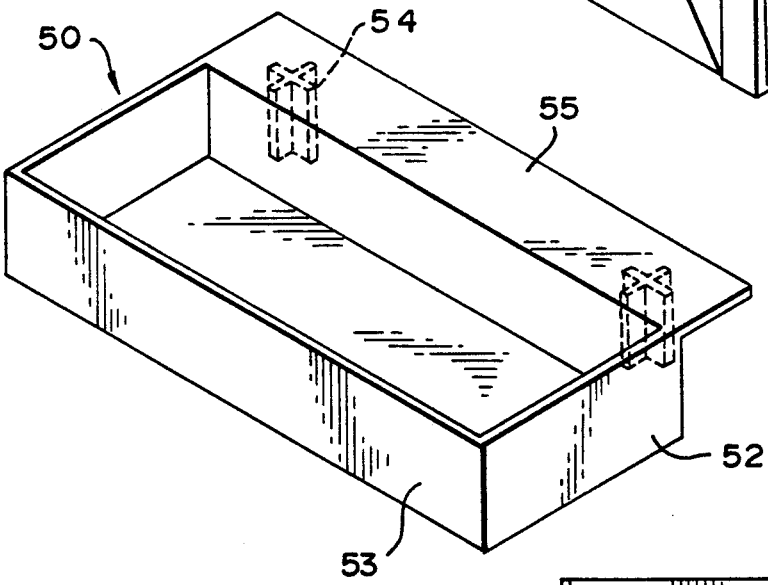
FIG. 12 is a perspective view of a tray which is adapted to be attached to the recess in the article supporting member.
Figure 13:
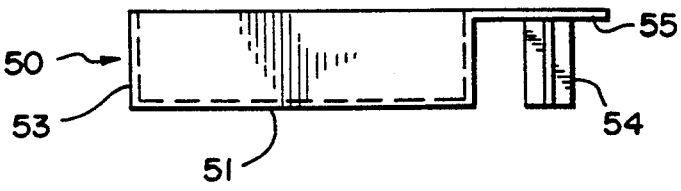
FIG. 13 is a side view of the tray shown in FIG. 12.

FIGS. 12 and 13 show a tray 50 which is adapted to be held in recesses 44 by projections 54. Tray 50 can be attached at any location on the modular stand, thereby allowing the user to custom build a stand which best suits his or her needs.

The tray 50 includes a bottom wall 51 and side walls 52 and 53 which are connected together to form a well for holding objects. On one of the side walls 53 there is a lip 55 which extends outward a sufficient distance to allow projections 54 to be spaced from side wall 53. Thus, side wall 53 can cooperate with front wall 41 of the article supporting member 40 to securely position tray 50.

Figure 2:
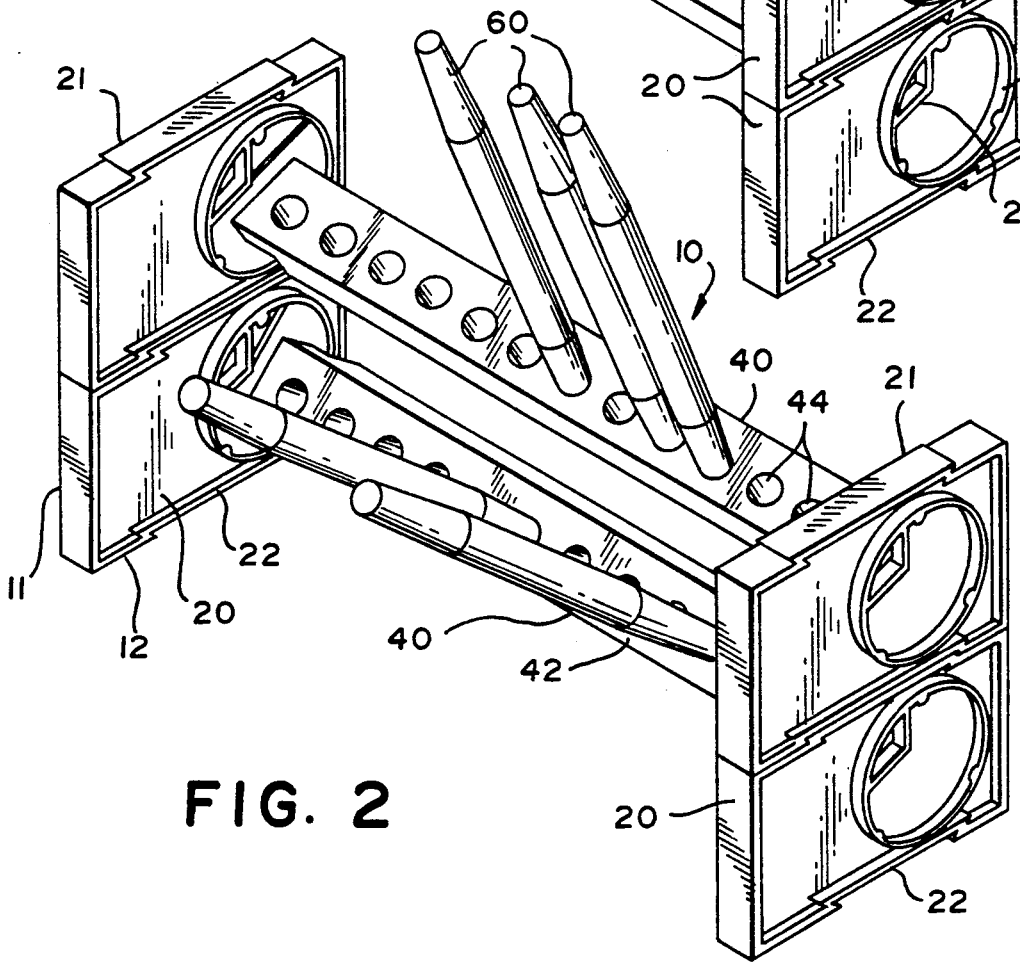
FIG. 2 is a perspective view of two modular stands attached vertically to one another with the lower article supporting member rotated downward.

One unique feature of the device is shown in FIG. 2. The connection means 23 and 43 function such that the article supporting member 40 may be rotated and held such that the markers held in the upper article supporting member may be seen with an unobstructed view. The user now has a clear view as well as no physical obstruction when reaching for a marker in the upper row.

Figure 1:
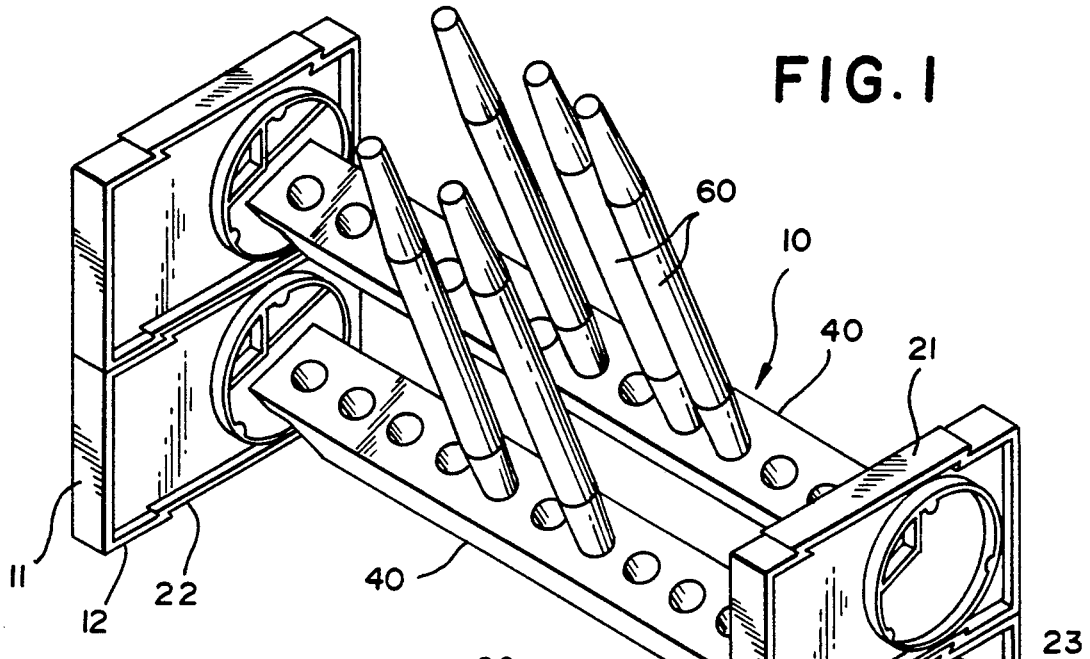
FIG. 1 is a perspective view of two modular stands attached vertically to one another.
Figure 3:
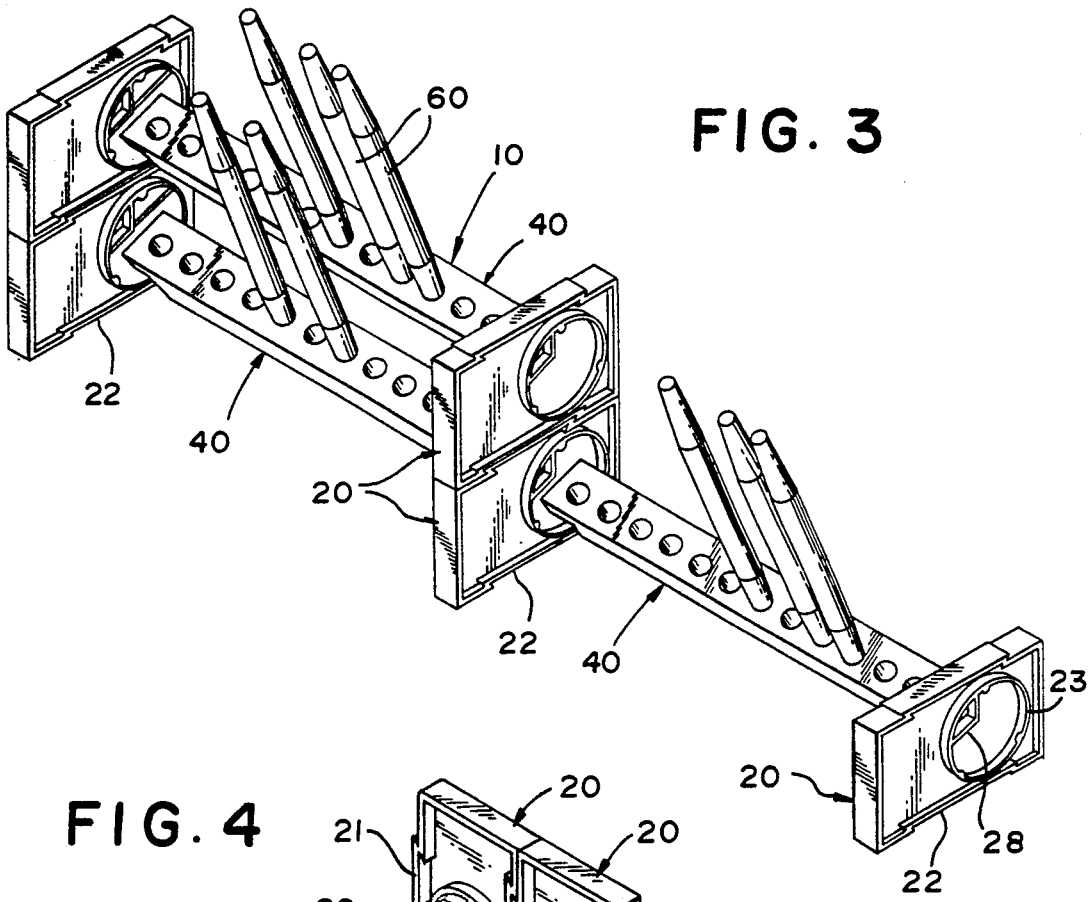
FIG. 3 is a perspective view of the modular stand attached in a side by side relationship.
Figure 4:
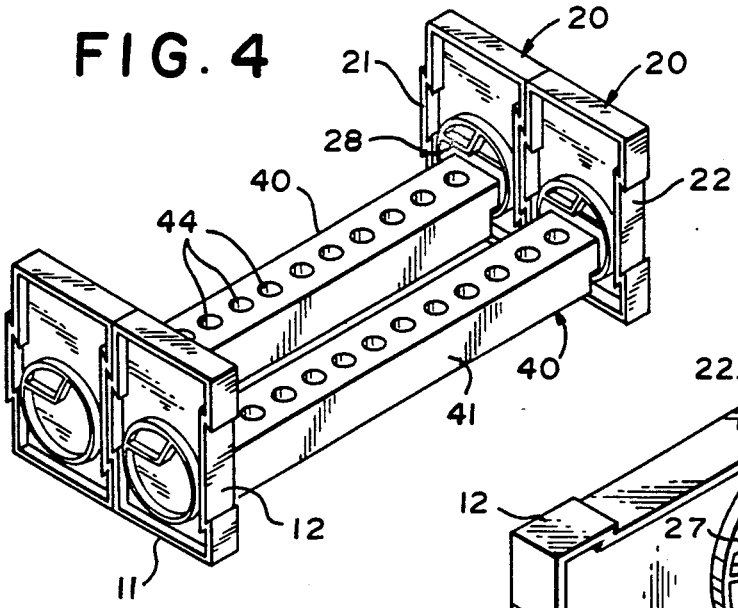
FIG. 4 is a perspective view of two modular stands connected as shown in FIGS. 1 and 2, however, the end walls are rotated 90° so as to rest on the short edge, with the article supporting members also being rotated.

The modular feature of the invention allows the display stand to be built in at least two planes. As shown in FIG. 1, and the end wall members 20 may be dovetail connected to rise vertically. In FIG. 3, the stand is connected together so as to expand vertically and horizontally. As stated earlier, the end wall members 20 include a female connection means 23 on both of its sides, thereby allowing an article supporting member 40 to be attached on both sides, thus sharing a common end wall member, making it a center wall.

Another feature of the invention is that the article supporting member may be rotated counter clockwise until it contacts stop 28. At this point, the upper surface 42 is parallel to the short edges 11 of the end wall member 20. The modular stand may now be turned on its back, that is to rest on a short edge, to support an object vertically (see FIG. 4), and the modular stand is now able to expand in a third front to back plane.

Therefore, when one's marker set expands so can one's display stand. For example, if all shades of red markers are to be kept on the first row and the artist has more red markers than recesses on a single article supporting member 40, all he needs to do is add another article supporting member 40 and an end wall 20 and his display stand will grow horizontally.

While various preferred embodiments have been shown and described, it will be understood that there is no intent to limit the invention by such disclosure, but rather, is intended to cover all modifications and alternate constructions falling within the spirit and scope of the invention as defined in the appended claims.

We claim:

1. A modular display stand comprising:

an article supporting member having an upper article retaining surface;

a pair of end wall members with peripheral edges;

a connection means including a male portion and female portion for removably and adjustably connecting said article supporting member between said end wall members such that said upper surface of said article supporting member can be rotated and held at a plurality of angles relative to the peripheral edges of said end wall members; and, wherein the male portion of said connection means includes a semi-circular disc secured at the ends of the article supporting member.

2. The invention of claim 1 wherein the upper article retaining surface includes a plurality of recesses.

3. The invention of claim 2 including a tray wherein said recesses cooperate with projections on said tray in order to removably attach said tray to the article supporting member.

4. The invention of claim 1 wherein said male semi-circular disc portions include an aligning means comprising a cutout approximate the midpoint of its circular circumference.

5. The invention of claim 1 wherein the female portion of said connection means includes a cylindrical outer wall located on both sides of said end wall members and said cylindrical outer wall having a plurality of retaining tabs extending inwardly and one of said retaining tabs also functions as an aligning means.

6. The invention of claim 5 wherein the female portion further includes a stop positioned within the circumference of said cylindrical outer wall which functions to stop both clockwise and counterclockwise movement of the ends of the article supporting member.

7. The invention of claim 6 wherein said stop is in the form of an angled wall.

8. The invention of claim 1 wherein the male portion and female portion of said connection means include aligning means which must be aligned to allow for interconnection and to allow the portions to turn clockwise or counterclockwise relative to one another to lock into place.

9. A modular display stand comprising:

an article supporting member having an upper article retaining surface;

a pair of end wall members with peripheral edges;

a connection means comprising a female portion located on both sides of said end wall members and a male portion secured to the ends of said article supporting member, wherein the connection between said male and female portion is selectively rotatable and allows each end wall member to be connected to an article supporting member on both sides of said end wall member.

10. The invention of claim 9 wherein the upper article retaining surface includes a plurality of recesses.

11. The invention of claim 9 wherein the male portion and female portion of said connection means include aligning means which must be aligned to allow for interconnection and to allow the portions to turn clockwise or counterclockwise relative to one another to lock into place.

12. The invention of claim 11 wherein the male portion of said connection means includes a semi-circular disc secured at the ends of the article supporting member.

13. The invention of claim 12 wherein said aligning means includes a cutout approximate the midpoint of said male semi-circular disc portions' circumferences.

14. The invention of claim 11 wherein the female portion of said connection means includes a cylindrical outer wall located on both sides of said end wall members and said cylindrical outer wall having a plurality of retaining tab extending inwardly and one of said retaining tabs also functions as said aligning means.

15. The invention of claim 14 wherein the female portion further includes a stop positioned within the circumference of said cylindrical outer wall which functions to stop both clockwise and counterclockwise movement of the ends of the article supporting member.

16. The invention of claim 15 wherein said stop is in the form of an angled wall.

17. The invention of claim 9 wherein the edges of said end wall members include attaching means for interconnecting a plurality of end wall members in selected configurations.

18. The invention of claim 10 including a tray wherein said recesses cooperate with projections on said tray in order to removably attach said tray to the article supporting member.

19. A modular display stand comprising:

an article supporting member having an upper article retaining surface;

a pair of end wall members with peripheral edges;

a connection means including a male portion and female portion for removably and adjustably connecting said article supporting member between said end wall members such that said upper surface of said article supporting member can be rotated and held at a plurality of angles relative to the peripheral edges of said end wall members; and, wherein the edges of said end wall members include attaching means for interconnecting a plurality of end wall members in selected configurations.

* * * * *